US008770697B2

(12) United States Patent
Wolanski et al.

(10) Patent No.: US 8,770,697 B2
(45) Date of Patent: Jul. 8, 2014

(54) PRINTER VACUUM UNIT MECHANISM

(75) Inventors: Tania Wolanski, Boulder, CO (US); William E. Manchester, Erie, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 406 days.

(21) Appl. No.: 12/879,184

(22) Filed: Sep. 10, 2010

(65) Prior Publication Data

US 2012/0062637 A1 Mar. 15, 2012

(51) Int. Cl.
*B41J 29/38* (2006.01)
*B41J 2/01* (2006.01)

(52) U.S. Cl.
USPC ..... 347/16; 347/104

(58) Field of Classification Search
USPC ..... 347/16, 104
See application file for complete search history.

(56) References Cited

U.S. PATENT DOCUMENTS

| | | | | |
|---|---|---|---|---|
| 3,829,080 | A | 8/1974 | Braen et al. | |
| 3,973,489 | A * | 8/1976 | Black | 101/115 |
| 4,218,026 | A * | 8/1980 | Stange | 242/417.1 |
| 4,512,651 | A | 4/1985 | Dunleavy, Jr. | |
| 4,627,718 | A | 12/1986 | Wyer | |
| 5,132,739 | A | 7/1992 | Mauer et al. | |
| 6,921,163 | B2 * | 7/2005 | Fujioka | 347/101 |
| 7,532,851 | B1 | 5/2009 | King | |
| 2006/0125901 | A1 | 6/2006 | Verhoest et al. | |
| 2006/0244980 | A1 | 11/2006 | Grace | |
| 2007/0070374 | A1 | 3/2007 | Boyes, Jr. et al. | |
| 2007/0092320 | A1 | 4/2007 | Taniguchi et al. | |
| 2009/0027449 | A1 | 1/2009 | Silva et al. | |
| 2010/0066781 | A1 | 3/2010 | Niihara et al. | |
| 2011/0102525 | A1 * | 5/2011 | Larson et al. | 347/102 |

OTHER PUBLICATIONS

"European Search Report", (Dec. 19, 2011), 3 pages.

* cited by examiner

*Primary Examiner* — Julian Huffman
(74) *Attorney, Agent, or Firm* — Blakely, Sokoloff, Taylor & Zafman LLP

(57) ABSTRACT

A printing system is disclosed. The printing system includes a first print engine to print content on a web of paper and a vacuum unit to provide stabilization and cooling of the web. The vacuum unit operates in a first mode upon receiving an activation signal from the first print engine and operates in a second mode upon de-assertion of the activation signal.

8 Claims, 3 Drawing Sheets

PRINTER VACUUM UNIT MECHANISM

FIELD OF THE INVENTION

The invention relates to the field of printing systems. Particularly, the invention relates to modifying print job data to prevent print voids in printing systems.

BACKGROUND

In the printing industry, it is sometimes necessary to process media multiple times in order to create a final product. For example, in order to implement duplex (e.g., two-sided) printing in high speed printers, media such as paper may have a first side printed at a first print engine and the second side printed at a second print engine. In other instances, a digital printer may not have enough capability (e.g., an ink jet printer may not be able to print Magnetic Ink Character Recognition (MICR), or a monochrome printer may not be able to print color/highlight color). In these cases, it may be necessary to process the media through multiple, independent digital printing devices in order to achieve the final product.

It some instances, a vacuum unit may be inserted between the printing engines in order to improve stability of the paper web. Moreover, utilizing the vacuum unit in conjunction with a cooling tower improves paper cooling by reducing the paper temperature to a significantly greater extent than conventional air cooling. However during duplex print operations, a print void may form on the second side (e.g., side 2) of the paper located within the vacuum unit whenever the paper web is stopped between printing devices.

Particularly, a side 2 void at the vacuum unit is created when hot paper loses or absorbs moisture in a non-uniform way. For instance, the paper is typically very hot from fusing (e.g., having been heated by the preheat platens and hot roll) upon exiting the first print engine. Thus, the vacuum unit metal rollers and metal sheet are hot from having absorbed heat from the moving paper web. Whenever the web motion is stopped, the paper remains in contact with the hot rollers and sheet in the vacuum unit.

While sitting on a hot roll the paper will absorb moisture at a much different rate than paper floating in air. However, when paper is being pulled down on a hot roll, moisture is absorbed on the sides of the paper, while the heat of the roll forces out the remaining moisture in the contact region of the paper. Around this contact area, paper is free standing in air and not in contact with any surfaces. The hot paper may absorb moisture in these airborne regions and cool off quickly compared to the regions sitting on the hot rollers and metal plates.

Losing moisture and being in contact with hot surfaces causes paper to shrink in the contact regions, while the free standing paper does not experience this shrinkage. In the transition or boundary area between heated/shrunk paper and free standing paper, the paper experiences a surface distortion (wrinkling, mottle, texturing, waviness, etc.). This distorted area, when passed through a second print engine in a duplex system, does not allow for good toner/ink transfer or fusing and side 2 voids are created. As a result, an undesirable loss of print data and blank regions in side 2 of the print output may occur.

One way to prevent side 2 voids is to avoid the use of a vacuum unit. However, using no vacuum unit at all would result in instability in the paper path, thus reducing printer performance and fewer crashes. Another solution is to use a muffin fan type of loop stabilizer (e.g., a Lasermax design). Nonetheless, muffin fan units do not stabilize the paper web and are very susceptible to outside air disturbances. Further, muffin fan units do not provide the additional cooling obtainable with vacuum units.

Accordingly, a mechanism for preventing vacuum unit paper voids during web stoppage in a printing system is desired.

SUMMARY

In one embodiment a printing system is disclosed. The printing system includes a first print engine to print content on a web of paper and a vacuum unit to provide stabilization and cooling of the web. The vacuum unit operates in a first mode upon receiving an activation signal from the first print engine and operates in a second mode upon de-assertion of the activation signal.

In a further embodiment, a method is disclosed. The method includes a vacuum unit operating in a first mode while receiving an activation signal, detecting de-assertion of the activation signal and entering a second mode of operation.

BRIEF DESCRIPTION OF THE DRAWINGS

A better understanding of the present invention can be obtained from the following detailed description in conjunction with the following drawings, in which.

DETAILED DESCRIPTION

A mechanism for preventing vacuum unit paper voids during web stoppage in a printing system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
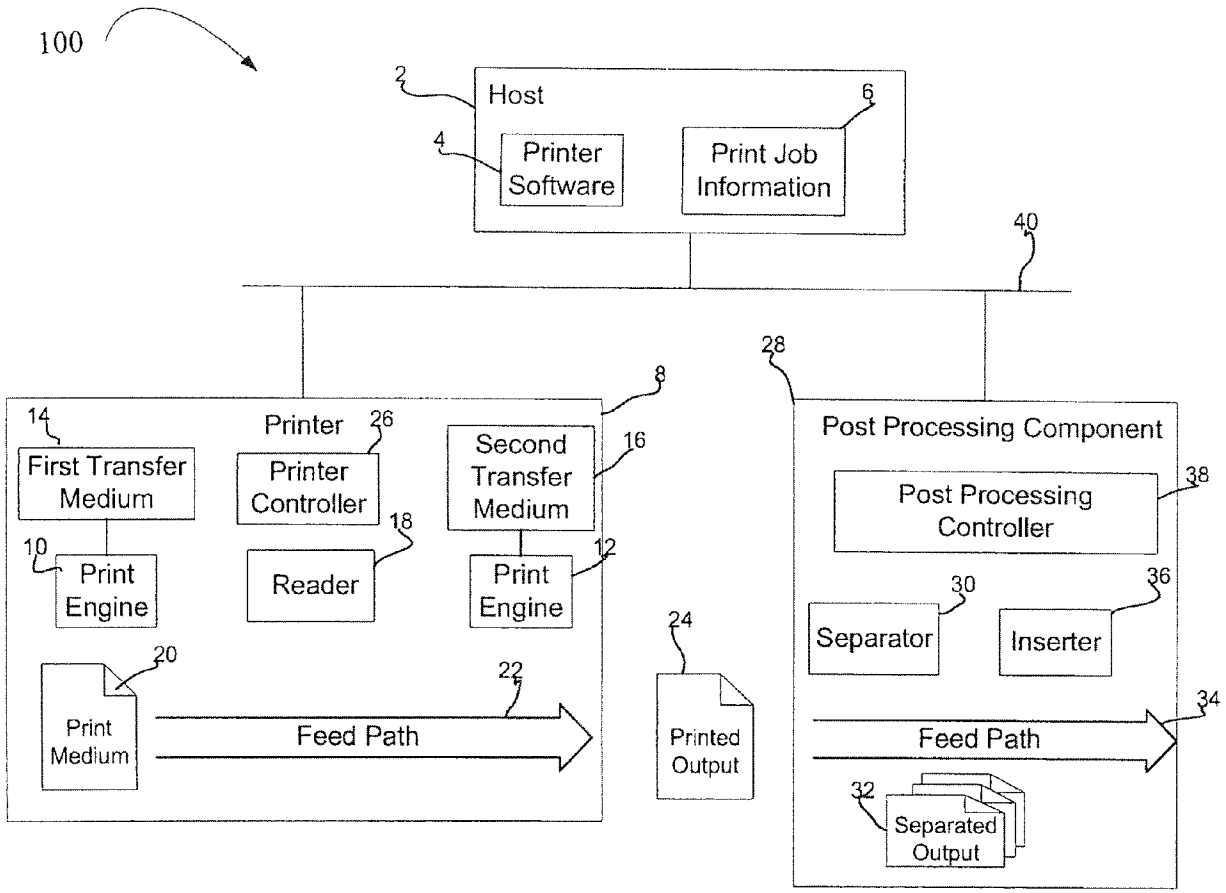
FIG. 1 illustrates one embodiment of a printing system.

FIG. 1 illustrates one embodiment of a printing system 100. Printing system 100 includes a host system 2 having print software 4 to manage print jobs and to maintain print job information 6 on the status of print jobs managed by the print software. In one embodiment, print software 4 may be implemented using either InfoPrint Manager (IPM) or InfoPrint ProcessDirector (IPPD), although other types of printing software may be used instead.

The term print job as used herein refers a print job or any component thereof, including a page of print content, a page including multiple print items or elements, such as checks, pages, an element on a page, etc. The print job may further include one or more pages, where each page has one or more elements, e.g., checks. A page may comprise a unit of print output, where the page may be outputted on a single piece of paper or multiple pages may be outputted on a roll, ribbon or web of paper. Pages may be outputted on a web of paper in different formats, such as 2-up duplex. Each of the pages on a web or roll of paper may include multiple elements. The web of paper may include print jobs, where each print job is one or more pages, and where each page includes one or more elements. In this way, elements and pages may be grouped in print jobs.

The host system 2 may include a processor (not shown) and memory (not shown) in which the print software 4 and print job information 6 is stored for access by the processor. The host system 2 communicates print jobs to the printer 8, where each print job may have one or more pages or elements, and where each page may have one or more elements. The printer 8 includes a first 10 and second 12 print engines to print output using first 14 and second 16 types of transfer media and a reader 18 capable of reading content printed using the first transfer medium 14.

A transfer media 14 and 16 includes the material or energy that is used to cause the formation of content on the print medium 20, such as toner, liquid ink, solid ink, dye, wax, heat (which when applied to thermal paper produces the print content), etc. A print medium 20, such as a piece of paper or other material or textile, is directed through a feed path 22 by mechanical components of the printer 8, such as rollers, guides, etc. In the feed path 22, the first print engine 10 prints first content of the one or more pages of one or more print jobs on the print medium 20 using the first transfer medium 14. The first content that is printed may comprise an element, a page, a page of elements, etc.

The reader 18 reads the printed first print content to determine the quality of the output. The reader 18 may read each element on one or more pages to determine the quality of each outputted element. The reader 18 forwards the print medium 20 to the second print engine 12 to print second content using the second transfer medium 16 to produce printed output 24 including one or more print jobs of one or more pages having one or more elements printed using both types 14 and 16 of transfer media.

The printer 8 may include a printer controller 26 to control printing operations and interface with the printer software 4 to execute the commands from the printer software 4 and provide feedback thereto. The print engines 10 and 12 may include the hardware and/or software to control the printing of content using the first 14 and second 16 types of transfer media, respectively.

The printed output 24 is forwarded to a post processing component 28 which performs various post processing operations on the printed output 24. The additional post processing performed on the separated output 32 pieces may include stapling, collating, printing, labeling, etc. The post processing component 28 then outputs the separated output 32 in a final form, which may comprise envelopes including the separated output 32 pieces. The post processing component 28 may include a post processing controller 38 to control post processing operations and interface with the printer controller 26 and printer software 4 to execute the commands from the printer software 4 and provide feedback thereto.

An interface 40 provides intercommunication among the host 2, the printer 8, and the post processing component 20. The interface 40 may include a network, such as a Local Area Network (LAN), a Wide Area Network (WAN), a wireless network, etc. Alternatively, the interface 40 may include a bus interface, parallel interface, serial interface, or other direct line connection. In the embodiment of described herein, the host 2, printer 8, and post processing component 20 are shown as included in separate boxes. In an alternative implementation, the printer 8 and post processing component 20 may be included in a single machine connected via one connection to the host 2. Alternatively, all three devices 2, 8, and 20 may be included in one machine.

Figure 2:
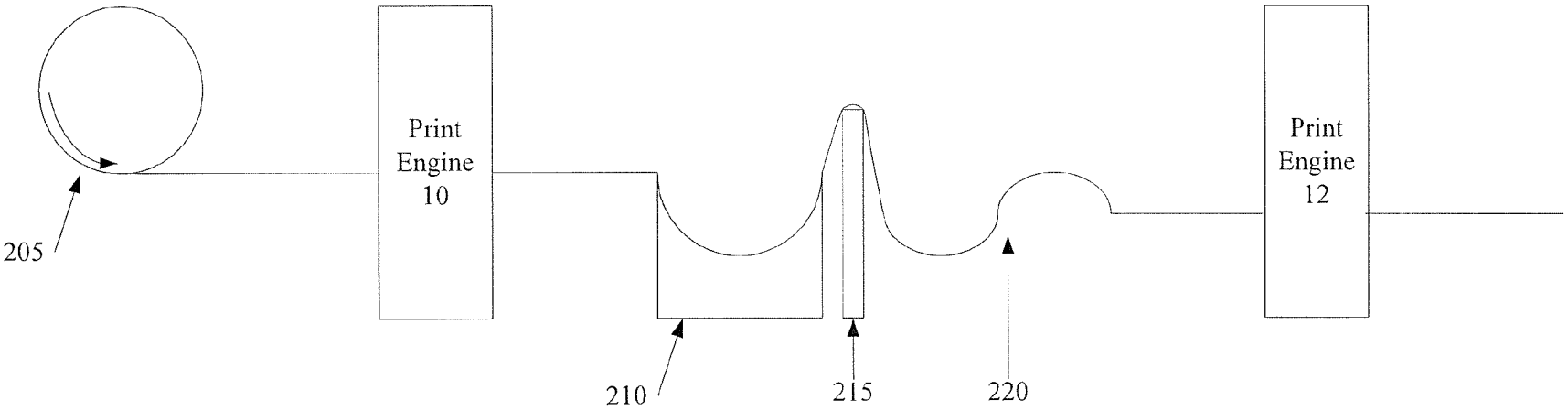
FIG. 2 illustrates a further embodiment of a printing system.

FIG. 2 illustrates one embodiment of the printer 8 paper path. As shown in FIG. 2, the paper path begins with a paper roll 205 that provides the paper web to print engine 10. In one embodiment, print engine 10 prints data onto the top side of the paper web. Upon exiting print engine 10 the paper is received at vacuum unit 210, which causes the paper web emerging from the print engine 10 to be drawn into a loop by means of a vacuum. Subsequently, the paper web is received at a cooling tower 215 that assists in cooling the paper, along with vacuum unit 210. The paper web is then flipped by an air flipper 220 to prepare for print engine 12 to print on the second side of the paper web.

Figure 3A:
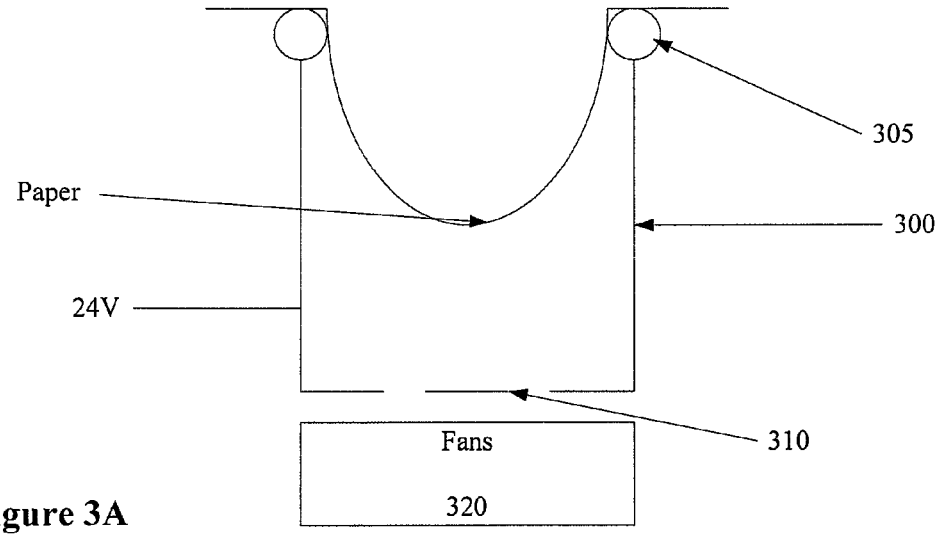
FIGS. 3A and 3B illustrate embodiments of a vacuum unit.

FIG. 3A illustrates one embodiment of vacuum unit 210. Vacuum unit 210 includes a tub 300, rollers 305, and grate 310 at the bottom of tub 300. Vacuum unit 210 also includes fans 320 below grate 310. Fans 320 suck air through grate 310 to cool the paper as the paper web flows through tub 300. In one embodiment, vacuum unit 210 is a Hunkeler vacuum unit. However in other embodiments, various vacuum units may be implemented without departing from the scope of the invention.

As discussed above, a void may occur as a result of paper sitting on hot rollers 305 and metal of tub 300 whenever the paper web is stopped between print engine 10 and print engine 12. According to one embodiment, print engine 10 transmits an activation signal to vacuum unit 210 whenever print engine 10 is in operation. In such an embodiment, the signal is 24VDC power source received from print engine 10. Nonetheless, other embodiments may implement different low voltage signals. While receiving the signal from print engine 10, vacuum unit 210 performs in a full operation mode. Thus, grate 310 is in an open position while fans 320 sucks air into tub 300 in order to create the vacuum, which causes the paper to be pulled into tub 300, as shown in FIG. 3A.

Figure 3B:
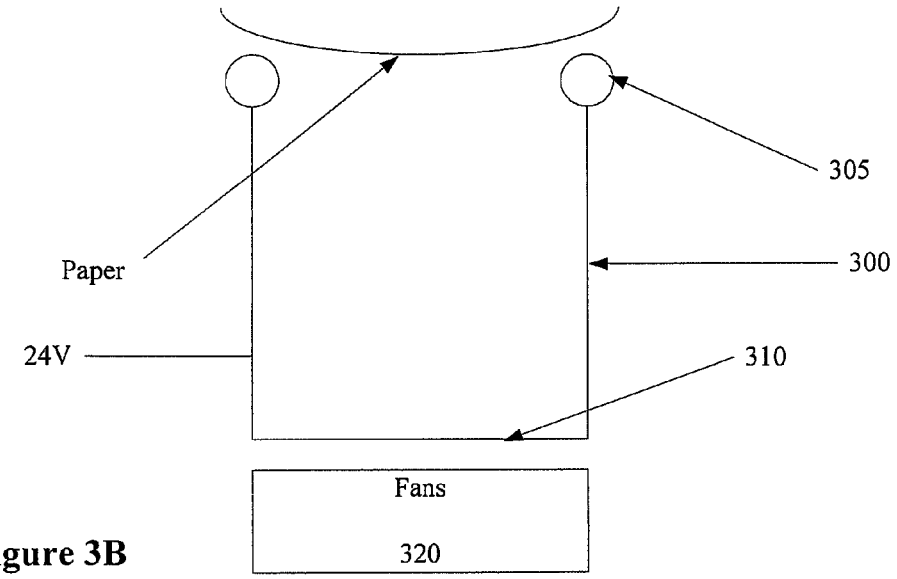

In one embodiment, vacuum unit 210 enters a standby mode whenever print engine 10 ceases operation. The standby mode is triggered by print engine 10 de-asserting the activation signal to vacuum unit 210. In a further embodiment, removing the signal results in power to fans 320 being removed and grate 310 being closed. Powering down fans 320 and closing grate 310 causes the paper web to drift out of tub 300 due to removal of the vacuum (see FIG. 3B). According to one embodiment, the grate opening/closing 310 is facilitated by a solenoid that includes an additional power source.

Because the paper is no longer in contact with the hot rollers 305 and metal sheet when the paper web movement is stopped, there is no differential moisture loss or absorption and associated shrinkage and distortion. Thus, side 2 void formation at the vacuum unit 210 is eliminated and no associated voids are present when printing occurs at print engine 12. Once print engine 10 again begins moving paper, the activation signal is again asserted and vacuum unit 210 is powered on. Thus, fans 320 are powered on and grate 310 is opened to the original position.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. A printing system comprising:

a first print engine to print content on a web of paper; and a vacuum unit to provide stabilization and cooling of the web, including:

a tub;

a grate at the bottom of the tub; and one or more fans below the grate, wherein the web is pulled into the tub while the grate is maintained in an open position and the fan is powered during assertion of an activation signal by the print engine, and wherein the web is positioned out of the tub while the fan is powered down and the grate is closed after de-assertion of the activation signal by the print engine.

2. The printing system of claim 1 further comprising a second print engine to print content on the web.

3. The printing system of claim 2 wherein the first print engine prints content on a first side of the web and the second print engine prints content on a second side of the web.

4. A method comprising:

pulling a web of paper into a tub of a vacuum unit while receiving an activation signal, wherein the vacuum unit maintains a grate at a bottom end of a vacuum tub in an open position and operates a fan to pull air through the grate while receiving the activation signal;

detecting de-assertion of the activation signal; and the web drifting out of the vacuum unit upon detecting de-assertion of the activation signal, wherein the fan is powered down and the grate is closed after de-assertion of the activation signal.

5. The method of claim 4 wherein the web is pulled into the tub by the fan pulling air through the grate.

6. The method of claim 4 wherein the vacuum unit powers off the fan upon detecting de-assertion of the activation signal.

7. The method of claim 6 wherein the web drifts out of the tub after the grate has closed and the fan has powered off.

8. A vacuum unit comprising:

a tub;

a grate at the bottom of the tub;

one or more fans below the grate; and a solenoid coupled to the grate to receive an activation signal from a print engine, wherein a web of paper is pulled into the tub while the grate is maintained in an open position by the solenoid and the fan is powered while receiving the activation signal, and wherein the web is positioned out of the tub while the fan is powered down and the grate is closed by the solenoid upon de-assertion of the activation signal.

* * * * *